US005361879A

United States Patent [19]

Lin

[11] Patent Number: 5,361,879

[45] Date of Patent: Nov. 8, 1994

[54] EXTENSION CORD REEL

[76] Inventor: Yeong-hwa Lin, 90-2, sec.3 Jia yen Road, sune lin town, Taipei Shien,

[21] Appl. No.: 105,814

[22] Filed: Aug. 11, 1993

[51] Int. Cl.[5] ..... H02G 11/02

[52] U.S. Cl. ..... 191/12.4

[58] Field of Search ..... 191/12 R, 12.2 R, 12.2 A, 191/12.4

[56] References Cited

U.S. PATENT DOCUMENTS

| | | | |
|---|---|---|---|
| 2,070,561 | 2/1937 | Cantor | 191/12.4 |
| 2,348,966 | 5/1944 | Dow et al. | 191/12 R X |
| 2,565,452 | 8/1951 | Johnson et al. | 191/12.2 R X |
| 2,821,579 | 1/1958 | Benjamin | 191/12.4 |
| 2,825,924 | 3/1958 | Humphrey | 191/12.2 R X |
| 2,976,374 | 3/1961 | Poulsen | 191/12.4 |
| 2,979,576 | 4/1961 | Huber | 191/12.4 |
| 3,773,987 | 11/1973 | Davis et al. | 191/12.4 |
| 3,837,448 | 9/1974 | Hagstrom | 191/12.4 |
| 4,114,736 | 9/1978 | Scherenberg | 191/12.4 |
| 4,300,665 | 11/1981 | Arechaga | 191/12.4 |
| 4,656,320 | 4/1987 | Maddock | 191/12.4 |
| 4,713,497 | 12/1987 | Smith | 191/12.2 R |
| 4,725,697 | 2/1988 | Kovacik et al. | 191/12.4 |
| 5,056,698 | 10/1991 | Kozakevich | 191/12.2 R X |
| 5,071,367 | 12/1991 | Luu | 191/12.4 X |
| 5,101,082 | 3/1992 | Simmons et al. | 191/12.2 R |

FOREIGN PATENT DOCUMENTS

| | | | |
|---|---|---|---|
| 2376541 | 9/1978 | France | 191/12.2 R |
| 3523213 | 1/1987 | Germany | 191/12.4 |
| 3528745 | 2/1987 | Germany | 191/12.2 R |

*Primary Examiner*—Michael S. Huppert
*Assistant Examiner*—Scott L. Lowe
*Attorney, Agent, or Firm*—Pro-Techtor International

[57] ABSTRACT

A locating device of retracting and storing an electric extension cord is provided with a retaining device capable of locking and retaining the extension cord as desired after the extension cord has been pulled out, without the risk that the extension cord so locked and retained is retracted accidentally by a retrievable spring disposed in a retracting and storing mount. In the process of retracting the extension cord that is pulled out, the retaining device is caused to release the extension cord, which is then retracted rapidly by the retrievable spring and stored in the retracting and storing amount.

5 Claims, 6 Drawing Sheets

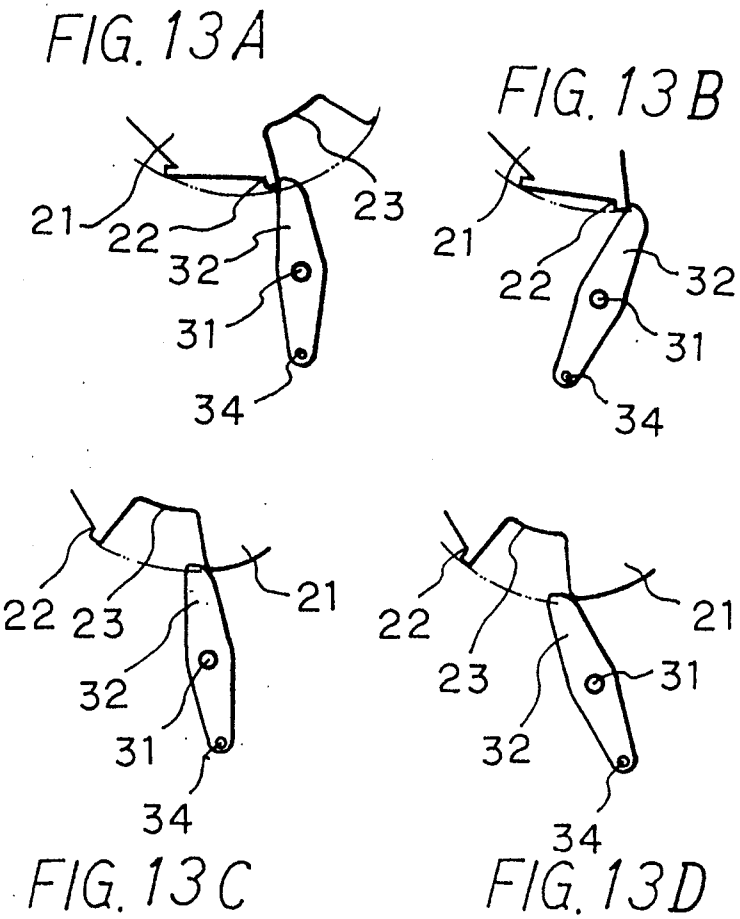
FIG. 13A
21
22
23
32
31
34
FIG. 13B
21
22
32
31
34
FIG. 13C
21
22
23
32
31
34
FIG. 13D
21
22
23
32
31
34
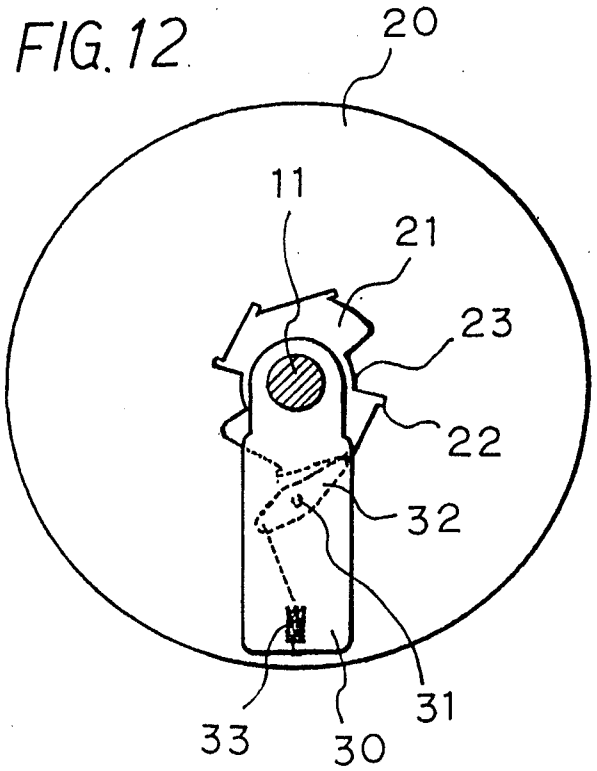
FIG. 12
20
11
21
23
22
32
31
30
33

EXTENSION CORD REEL

BACKGROUND OF THE INVENTION

The present invention generally relates to an electrical accessory, and more particularly to an extension cord reel.

There are many prior art extension cord reels for use in either an indoor condition or an outdoor condition are operated manually, as exemplified shown in U.S. Pat. Nos. 4,656,320; 4,725,697; 5,056,698; and 5,071,367 et al. Such manually operated extension cord reels as mentioned above are inefficient and time-consuming. In addition, the extension cord reels disclosed in the above-identified U.S. Pat. Nos. 5,056,698 and 5,071,367 are designed in such a manner that the retracted cord is exposed without being protected by a shield, thereby causing the extension cord to become vulnerable to the damage caused by the destructive pests such as the rat and the like. Moreover, the retracted extension cord are tied up by means of ropes or rubber rings for ease of storing the retracted extension cord. However, such tied up extension cord are bound to intertwine so as to inconvenience the reuse of the extension cord and even to cause the breakage of the copper wires of the extension cord.

U.S. Pat. No. 4,842,108 also shows an electric cord reel which is limited in design in that its retracting mechanism is not operable without electricity.

SUMMARY OF THE INVENTION

It is therefore the primary objective of the present invention to provide an extension cord reel with a retaining device which comprises a pressing rod element, a pawl pivoted to a first spring, a second spring mounted on a pivot of the pressing rod element, and an anti-skidding surface. The pressing rod element is urged by the first and the second springs to actuate the pawl to remain adjacent to the anti-skidding surface so as to clamp the extension cord passing therethrough. The extension cord is therefore permitted to move in unilateral direction.

It is another objective of the present invention to provide an extension cord reel which is so dimensioned as to be suitable for a household use and provided with a retaining device capable of being slid manually in a guide slot located in the inner edge of a storing mount disposed over the extension cord exit. The retaining device is therefore capable of refraining the extension cord from moving back and forth and of moving closer to or moving away from the lower side of the extension cord exit so as to regulate the location and the retraction of the extension cord passing therethrough.

It is still another objective of the present invention to provide an extension cord reel with a retaining device located on a winding disk and provided with an arresting wheel having a single bevel ratchet and a baffle for preventing a backward movement. The ratchet of the arresting wheel is provided with a switching portion for enabling the baffle to change the direction so as to permit the winding disk to retract the extension cord rapidly and to subdue the plug attached to the extension cord.

My invention will be further described in relation to a preferred embodiment thereof, taken in conjunction with the accompanying drawings.

BRIEF DESCRIPTION OF THE DRAWINGS

FIG. 12 shows a side sectional view of the third preferred embodiment as shown in FIG. 11; and FIGS. 13A–D are enlarged views illustrating the action of the baffle as shown in FIG. 12.

DETAILED DESCRIPTION OF THE PREFERRED EMBODIMENTS

Figure 2:
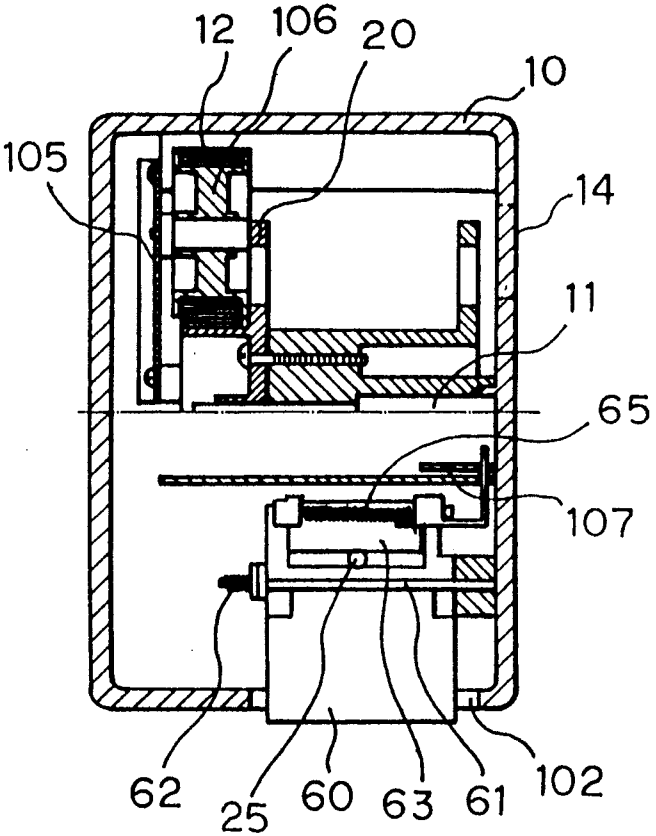
FIG. 2 shows a side sectional view of the first preferred embodiment as shown in FIG. 1.
Figure 1:
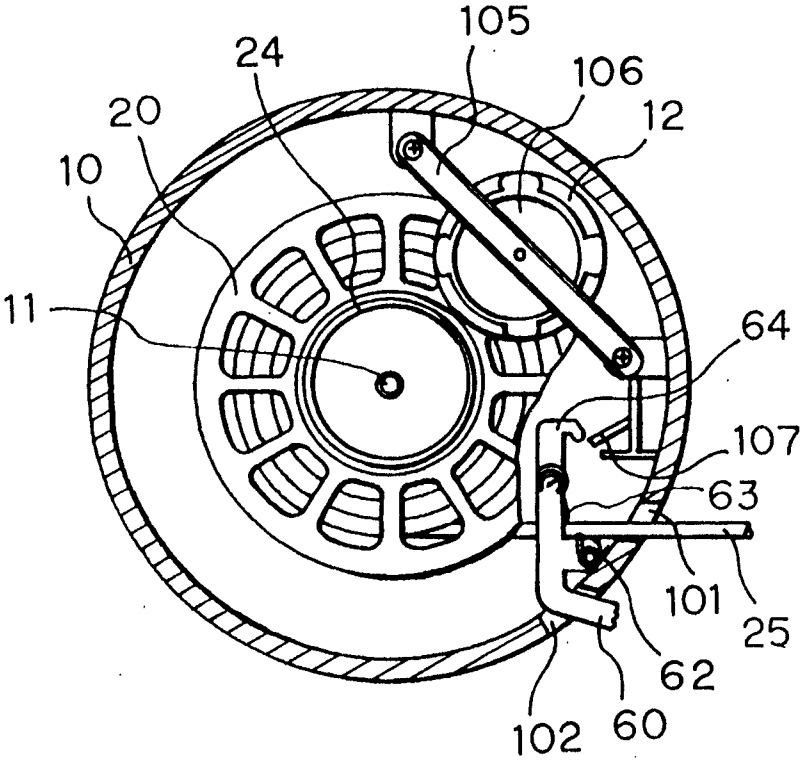
FIG. 1 shows a sectional view of a first preferred embodiment of the present invention.

Referring to FIGS. 1–4, an extension cord reel of the present invention for a household use is shown to comprise at least a storing mount 10, a cord winding disk 20, an extension cord 25, a support frame 105, a spring winding wheel 106, a retrievable spring 12, and a retaining device.

The storing mount 10 is provided therein centrally with the cord winding disk 20 mounted on a reel 11 for winding the extension cord 25. The storing mount 10 is further provided with an extension cord exit 101 and a through hole 102. Located at an appropriate position of the extension cord exit 101 is a retaining portion 107. The extension cord exit 101 is further provided at the appropriate position thereof with a plurality of extension cord connection holes 14.

The cord winding disk 20 is disposed pivotally in the storing mount 10 and provided with a retrieable spring winding portion 24.

The extension cord 25 is wound on the cord winding disk 20, with one end in contact with conductive spring pieces disposed in the extension cord connection holes 14, and with another end emerging from the extension cord exit 101 and having a plug (not shown) attached thereto.

The support frame 105 is disposed at an appropriate position by the cord winding disk 20 in the storing mount 10.

The spring winding wheel 106 is pivoted to the support frame 105 such that the spring winding wheel 106 can be caused to turn freely.

The retrievable spring 12 is fitted over the spring winding wheel 106, with the outer end of the retrievable spring 12 fitting over the retrievable spring winding portion 24 of the cord winding disk 20.

A retaining device comprise a retaining element 60 fastened by means of a pivot 61 to the inside of the storing mount 10 located between the extension cord exit 101 and the through hole 102. The retaining element 60 has one end that extends beyond the through hole 102 and another end that extends through the extension cord exit 101 and has a pawl 63 attached thereto. The retaining element 60 and the pawl 63 are caused to remain perpendicular to each other by means of a first spring 65 and a second spring 62 (see FIG. 3). The extension cord exit 101 is provided on the inner wall surface thereof with an anti-skidding surface 66.

The retracting action of the cord winding disk 20 is triggered by the retrieving force of the retrievable spring 12 at the time when the extension cord 25 is pulled out of the cord winding disk 20 for a predetermined length and then is released. In the meantime, the retaining element 60 and the pawl 63 are acted upon respectively by the first spring 65 and the second spring 62, thereby causing the pawl 63 to remain close to the anti-skidding surface 66. The distance in the vertical direction between the anti-skidding surface 66 and the pawl 63 is smaller than the diameter of the extension cord 25 located horizontally, so as to bring about a leverage-like retaining effect in unilateral direction.

Figure 4:
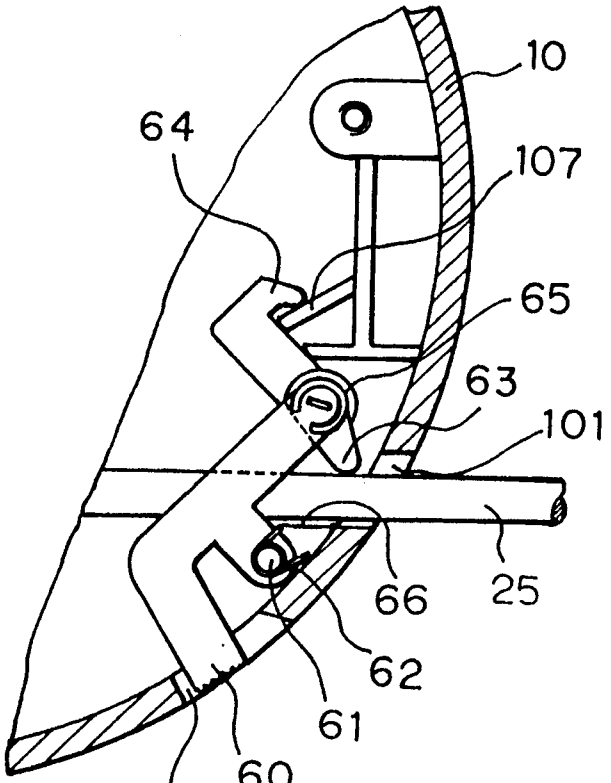
FIG. 4 is a schematic view illustrating the action of the portion as shown in FIG. 3.
Figure 3:
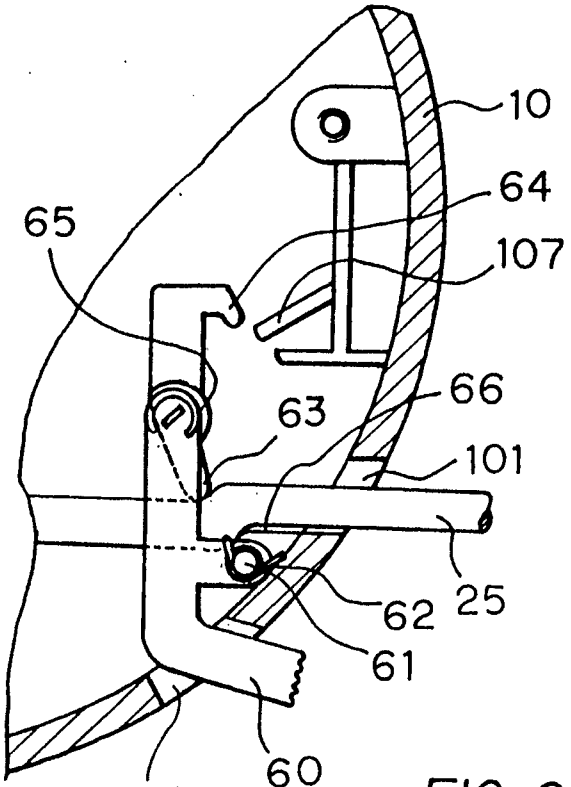
FIG. 3 shows a partial enlarged sectional view of the first preferred embodiment of the present invention.
Figure 6:
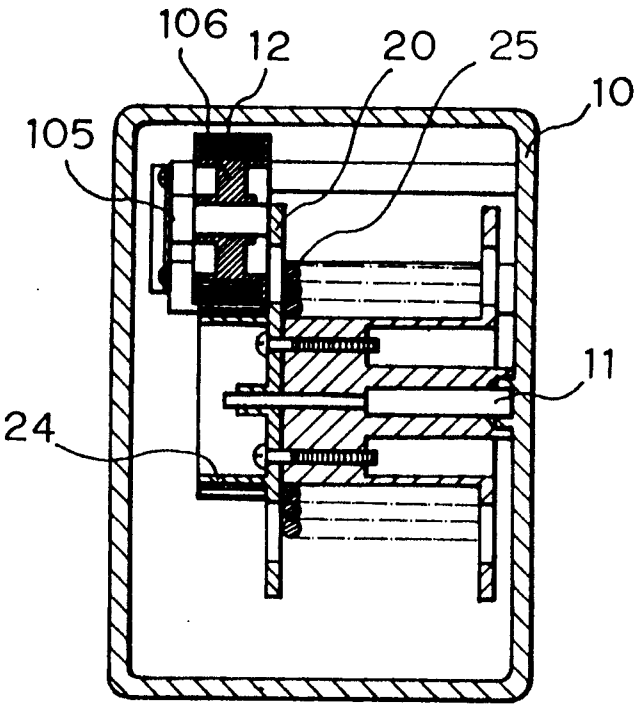
FIG. 6 shows a side sectional view of the second preferred embodiment as shown is FIG. 5.
Figure 5:
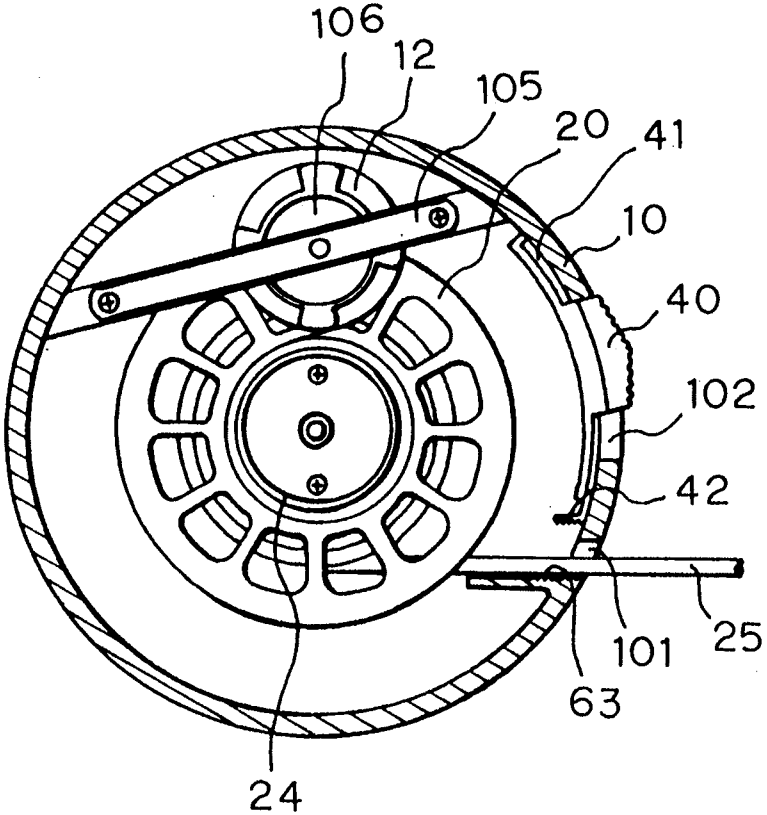
FIG. 5 shows a sectional view of a second preferred embodiment of the present invention.
Figure 9:
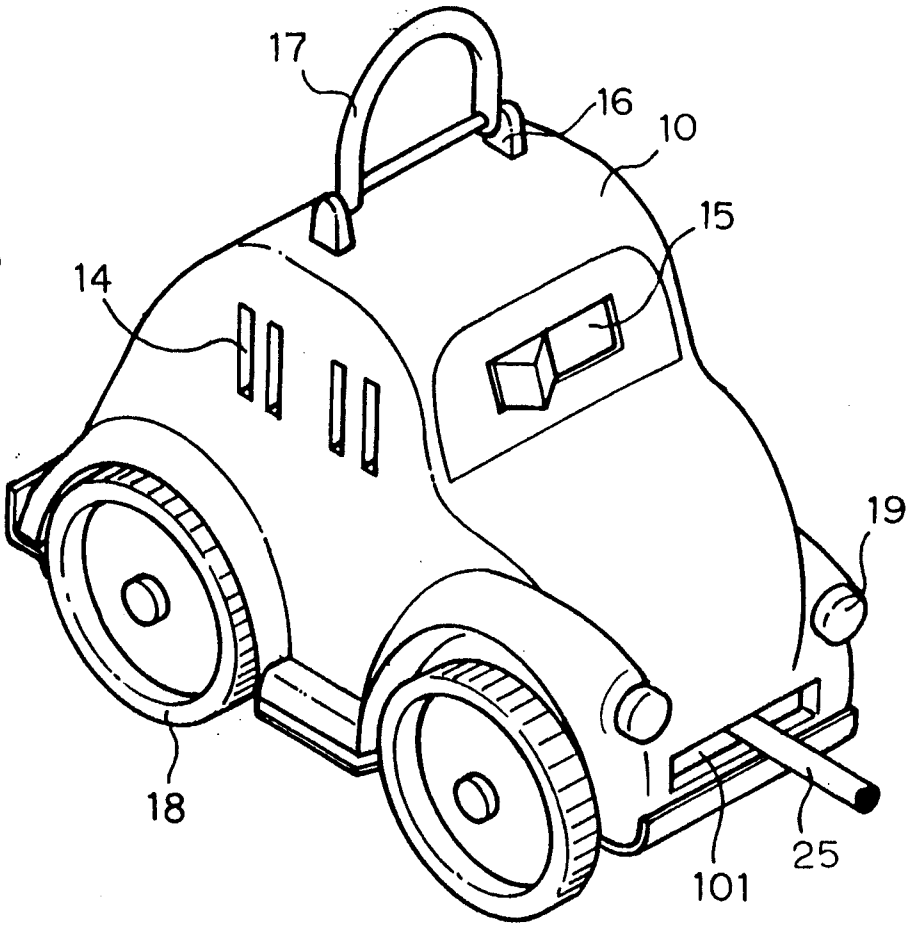
FIG. 9 shows a perspective schematic view of a third preferred embodiment of the present invention.
Figure 8:
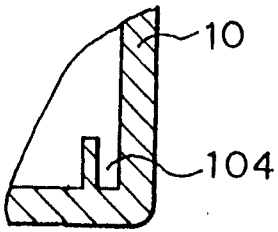
FIG. 8 shows a sectional view of the portion of the second preferred embodiment as shown in FIG. 7.
Figure 7:
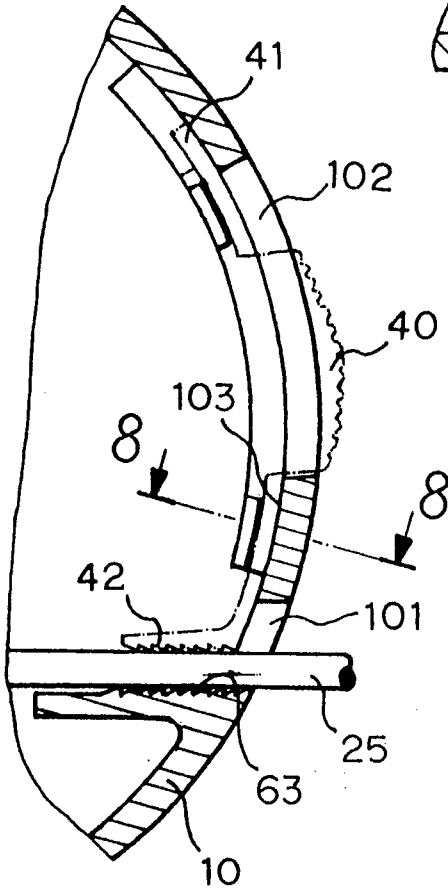
FIG. 7 shown a partial enlarged sectional view of the second preferred embodiment as shown in FIG. 5.
Figure 10:
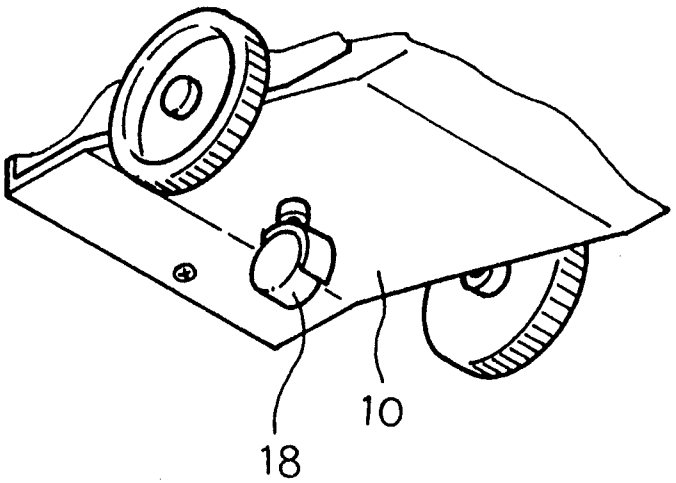
FIG. 10 shows a partial bottom plan view of the third preferred embodiment as shown in FIG. 9.

The pawl 63 has one end forming a hook portion 64 engageable with the retaining portion 107. As shown in FIG. 4, the hook portion 64 is stopped by the retaining portion 107 at the time when the pawl 63 is driven by the retaining element 60 to move away from the extension cord exit 101 so that the distance between the pawl 63 and the anti-skidding surface 66 is so increased that it is slightly greater than the diameter of the extension cord 25. The pawl 63 is therefore locked so as to permit the extension cord 25 to be retracted rapidly by the cord winding disk 20.

With reference to FIGS. 5–8, the second embodiment of the present invention comprises a storing mount 10 provided therein centrally with a cord winding disk 20 mounted on a reel 11. The cord winding disk 20 is intended for use in winding thereon the extension cord 25. The storing mount 10 is further provided with an extension cord exit 101 and a through hole 102. The extension cord exit 101 is provided on a lower edge thereof with an anti-skidding surface 63 which is unidirectionally beveled and serrated. The through hole 102 is provided along the inner side of the circumference thereof with an arcuate guide slot 103.

The cord winding disk 20 is disposed pivotally in the storing mount 10 and provided in one side thereof with a retrievable spring winding portion 24.

An extension cord 25 is wound on the cord winding disk 20 and has one end in contact with a conductive spring piece disposed in an extension cord connection hole 14. The extension cord 25 has another end passing through the extension cord exit 101 of the storing mount 10 and having a plug (not shown) attached thereto.

A support frame 105 is disposed at an appropriate position by the cord winding disk 20 of the storing amount 10.

A spring winding wheel 106 is pivoted to the support frame 105 and can be caused to turn freely.

A retrievable spring 12 is fitted over the spring winding wheel 106 and has an outer end fitting over the retrieable spring winding portion 24 of the cord winding disk 20.

A retaining device comprises a retaining element 40 which is received in the guide slot 103 of the through hole 102 of the storing mount 10 such that the retaining element 40 can be caused to slide freely backward and forward in the slot 103. The mid-section of the retaining element 40 has an outer side projecting beyond the through hole 102 for an appropriate height. The retaining element 40 has a guide portion 41 with a lower end provided with a pressing portion 42 which has a unidirectional bevel serration and is corresponding in location to the anti-skidding surface 63.

The extension cord 25 can be pulled out and then locked by pressing the retaining element 40 so as to cause the guide portion 41 to move downward in the guide slot 103. As a result, the extension cord 25 is clamped securely by the pressing portion 42 and the anti-skidding surface 63. The extension cord 25 can not be accidentally caused by the pulling force of the retrievable spring 12 to be retracted again by the cord winding disk 20 in view of the fact that the extension cord 25 is different in moving direction from the retaining element 40.

The extension cord 25 that is pulled out can be subsequently retracted by pushing upward the retaining element 40 so as to cause the guide portion 41 to move upward in the guide slot 103 until such time when the extension cord 25 is no longer clamped by the pressing portion 42 and the anti-skidding surface 63. As a result, the extension cord 25 is pulled by the retrievable spring 12 so as to be retracted by the cord winding disk 20.

The third embodiment of the present invention is illustrated in FIGS. 9–13 and is intended for use in an outdoor condition or an industrial application. This embodiment comprises a storing mount 10 provided therein centrally with a reel 11 retaining in a stationary state. The storing mount 10 is further provided respectively at appropriate positions thereof with an extension cord exit 101, a plurality of insertion holes 14, a power switch 15, a plurality of casters 18, a lighting fixture 19, a couple of handle seats 16, and a hand grip 17 pivoted to the handle seats 16.

A bracket 30 of a platelike construction is disposed securely in the storing mount 10.

Figure 11:
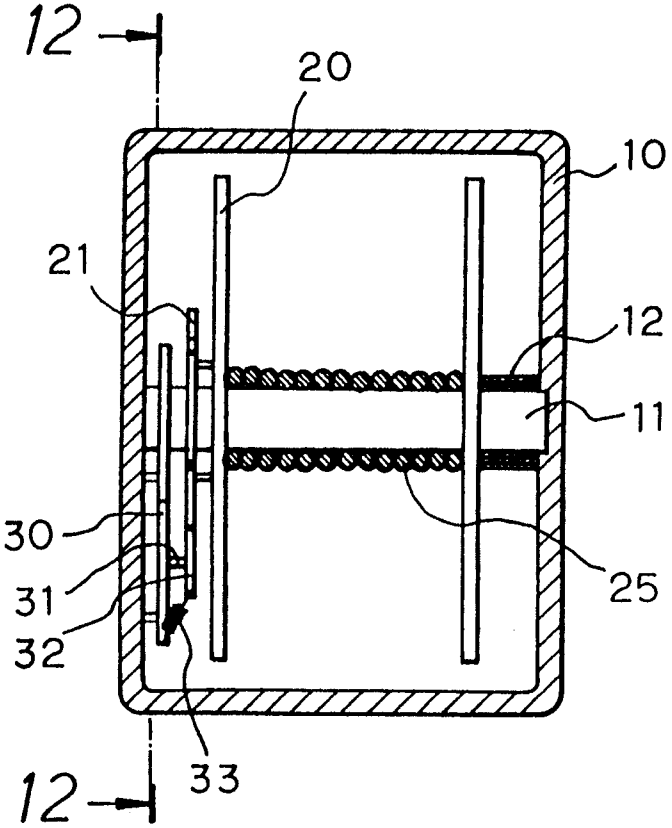
FIG. 11 shows a sectional view of the third preferred embodiment of the present invention.

A cord winding disk 20 is mounted pivotally on the reel 11 located in the storing mount 10 and is parallel to the bracket 30, as shown in FIG. 11. The cord winding disk 20 is capable of turning on the reel 11 so as to wind thereon the extension cord 25. The cord winding disk 20 is provided with a braking wheel 21 adjacent to the bracket 30 and capable of turning synchronously with the cord winding disk 20. The braking wheel 21 is provided on the outer circumference thereof with a plurality of unidirectionally beveled pawls 22 which are spaced equidistantly, and with one or more recessed escaping portions 23.

A retrievable spring 12 has an inner end that is fitted over the reel 11 and an outer end that is fastened with the cord winding disk 20.

A stopping block 32 has a shaft 31 by means of which the stopping block 32 is mounted pivotally on the bracket 30 such that one end of the stopping block 32 is retained obliquely by the pawl 22 of the braking wheel 21, and that another end of the stopping block 32 is caught and pulled by a tension spring 33 fastened to the bracket 30 and to the stopping block 32 by means of a spring fastening hole 34. See FIGS. 13A–D.

In operation, the extension cord 25 can be pulled out via the extension cord exit 101 so as to trigger a synchronous rotation of the cord winding disk 20 and the braking wheel 21. In the meantime, one end of the stopping block 32 is no longer retained by the pawl 22 of the braking wheel 21. As soon as the pulling of the extension cord 25 ceases, the extension cord 25 is locked and retained by the back winding action of the retrievable spring 12 of the cord winding disk 20.

The extension cord 25 that is pulled out can be retracted by pulling the extension cord 25 slightly further out to cause the tension spring 33 to exert a pulling force on the stopping block 32 at connection point 34 and the retaining end of the pawl 22, thereby causing the stopping block 32 to turn backward on the shaft 31 so as to disengage the pawl 22 and to relocate in the escaping portion 23, as illustrated in FIGS. 13A–D. As soon as the pulling force to the extension cord 25 is released, the extension cord 25 is automatically retracted and wound on the cord winding disk 20 because the cord winding disk 20 and the braking wheel 21 rotate synchronously and the retaining end of the stopping block 32 is no longer engageable with the pawl 22 of the braking wheel 21.

The advantages of the present invention over the prior art are therefore apparent and summed up hereinafter.

The present invention provides the workable solutions to the shortcomings of the prior art described above. The present invention is suitable for use in both indoor and outdoor conditions for a household or industrial application. In addition, the present invention provides a means for locking the extension cord as desired after it has been pulled out. The present invention is further provided with casters for ease of transporting the present invention.

The retracting of the extension cord of the present invention can be triggered by pulling the extension cord slightly further out so as to cause the escaping porting of the braking wheel to move to the location where the stopping block is situated. As a result, the stopping block is caused to disengage the pawl of the braking wheel so as to permit the extension cord to be retracted automatically by virtue of the pulling force of the retrievable spring of the cord winding disk, without manually operating the retaining device. Furthermore, the plug that is attached to the extension cord does not sway violently at the time when the retraction of the extension cord is under way.

According to the present invention, the retracted extension cord is kept in the storing mount, thereby preventing the extension cord from being damaged by the destructive pest such as the rat.

What is claimed is:

1. A device for retracting and storing an electric extension cord comprising:

a retracting and storing mount centrally situated in the device, the retracting and storing mount including a reel, an extension cord exit, an extension cord socket hole, and a power switch, said device mount being further provided with a plurality of casters, a lighting fixture, and a hand grip mounted on handle seats;

a bracket is disposed securely in said retracting and storing mount with a cord winding disk mounted pivotally on said reel in said retracting and storing mount such that said cord winding disk is parallel to said bracket, and that said cord winding disk is provided with a braking wheel rotatable synchronously with said cord winding disk and facing said bracket, said braking wheel being provided on an outer circumference thereof with a plurality of pawls equidistantly spaced and unidirectionally beveled.

said braking wheel being further provided in a circumference thereof with one or more recessed escaping portions;

an extension cord is wound on said cord winding disk and has one end capable of making contact with a conductive spring piece disposed in said extension cord socket hole, said extension cord having a second end passing through said extension cord exit of said retracting and storing mount, said second end of said extension cord having a plug attached thereto;

a retrievable spring having an inner end fitting over said reel and having an outer end fastened to said cord winding disk;

and a stopping block mounted pivotally on said bracket by means of a shaft such that one end of said stopping block can be stopped and retained obliquely by said pawls of said braking wheel, and that a second end of said stopping block is fastened to one end of a tension spring, the second end of the tension spring being fastened to said bracket.

2. The retracting and storing device of claim 1 wherein:

an anti-skidding surface is provided on a lower inner surface of said extension cord exit, said anti-skidding surface being obliquely and outwardly corrugated and unidirectionally beveled and serrated; and wherein said retracting and storing mount is provided with a through hole adjacent to said extension cord exit and has a recessed guide slot disposed along an inner circumference thereof.

3. The retracting and storing device of claim 2 wherein:

said through hole of said retracting and storing mount is provided with a retaining device comprising a retaining element received in said guide slot, said retaining element having a guiding portion at each of its ends to enable said retaining element to slide backward and forward in said guide slot, said retaining element including a projecting midsection extending slightly beyond said through hole, said guiding portion of said retaining element being provided with a pressing portion opposite said anti-skidding surface and which is unidirectionally beveled and serrated.

4. The retracting and storing device of claim 1 wherein:

said retracting and storing mount is provided with a through hole adjacent to said extension cord exit and has a retaining device disposed therein, said retaining device comprising a retaining element which pivots between said extension cord exit and said through hole such that one end of said retaining element extends beyond said through hole, and a second end of said retaining element passes through said extension cord exit and has a pawl pivotally attached thereto, said retaining element and said pawl being disposed perpendicular to each other by means of a first spring and a second spring, said extension cord exit including an anti-skidding surface on an inner wall surface thereof.

5. The retracting and storing device of claim 4 wherein:

one end of said pawl has a hook portion which is stopped at a stopping and retaining portion when said pawl has moved a sufficient distance from said extension cord exit so that said extension cord is released.

* * * * *